US006564813B1

(12) United States Patent
Lengling et al.

(10) Patent No.: US 6,564,813 B1
(45) Date of Patent: May 20, 2003

(54) USE OF SOLUTIONS CONTAINING ENZYMES FOR CLEANING FERMENTATION OR STORAGE TANKS

(75) Inventors: Marion Lengling, Duesseldorf (DE); Harald Kluschanzoff, Mettmann (DE)

(73) Assignee: Ecolab GmbH & Co. OHG, Dusseldorf (DE)

( * ) Notice: Subject to any disclaimer, the term of this patent is extended or adjusted under 35 U.S.C. 154(b) by 0 days.

(21) Appl. No.: 09/463,376

(22) PCT Filed: Jul. 13, 1998

(86) PCT No.: PCT/EP98/04331

§ 371 (c)(1),
(2), (4) Date: Apr. 7, 2000

(87) PCT Pub. No.: WO99/05252

PCT Pub. Date: Feb. 4, 1999

(30) Foreign Application Priority Data

Jul. 22, 1997 (DE) ..... 197 31 398

(51) Int. Cl.[7] ..... B08B 9/00

(52) U.S. Cl. ..... 134/22.1; 134/2; 134/22.14; 134/25.3; 435/264; 510/218; 510/226; 510/234; 510/299; 510/300; 510/320; 510/321; 510/392; 510/393; 510/530

(58) Field of Search ..... 435/264; 134/22.1, 134/22.14, 25.3, 2; 510/226, 300, 305, 278, 234, 299, 320, 321, 392, 393, 530

(56) References Cited

U.S. PATENT DOCUMENTS

| | | | | |
|---|---|---|---|---|
| 4,081,396 A | | 3/1978 | Batterton | 252/106 |
| 4,842,771 A | | 6/1989 | Roerig et al. | 252/547 |
| 5,078,896 A | | 1/1992 | Roerig et al. | 252/102 |
| 5,540,784 A | | 7/1996 | Ranes | 134/10 |
| 5,858,117 A | * | 1/1999 | Oakes et al. | 134/26 |

FOREIGN PATENT DOCUMENTS

| | | | | |
|---|---|---|---|---|
| CN | 1 092 099 | | 9/1994 | |
| DE | 36 35 357 | | 4/1988 | |
| DE | 39 21 839 | | 1/1991 | |
| DE | 091 04 192 | | 8/1996 | |
| DE | 196 43 552 | | 4/1998 | |
| EP | 0 265 979 | | 5/1988 | |
| EP | 0 276 501 | | 8/1988 | |
| EP | 0 314 232 | | 5/1989 | |
| EP | 0 595 590 | | 5/1994 | |
| EP | 0 724 013 | | 7/1996 | |
| RO | 104 553 | | 9/1994 | |
| WO | WO95/02664 | | 1/1995 | |
| WO | WO 96/06532 | * | 7/1996 | ..... A01N/63/00 |
| WO | WO96/21721 | | 7/1996 | |
| WO | WO96/23579 | | 8/1996 | |
| WO | WO97/05227 | | 2/1997 | |
| WO | WO97/45523 | | 12/1997 | |

OTHER PUBLICATIONS

Database WPI, Class D16, An97–166048, XP002084967.
Database WPI, Class A97, An93–186697, XP002084968.
Derwent Patent Abstract (WPAT) No. 1998–251939[23].
Derwent Patent Abstract (WPAT) No. 1997–166048 [16].
Derewnt Patent Abstract (WPAT) No. 1993–186697 [23].
Derwent Patent Abstract (WPAT) No. 1988–113492 [17].
Derwent Patent Abstract (WPAT) No. 1996–371180 [37].
Derwent Patent Abstract (WPAT) No. 1991–022947 [04].

* cited by examiner

*Primary Examiner*—Randy Gulakowski
*Assistant Examiner*—M. Kornakov
(74) *Attorney, Agent, or Firm*—Merchant & Gould P.C.

(57) ABSTRACT

A process is presented for cleaning fermentation or storage tanks with an enzyme-containing formulation containing one or more laccases, peroxidases, oxireductases, transferases, isomerases, lyases, and ligases or a mixture thereof. The process provides improved cleaning results, water consumption, and waste water pollution.

13 Claims, No Drawings

USE OF SOLUTIONS CONTAINING ENZYMES FOR CLEANING FERMENTATION OR STORAGE TANKS

BACKGROUND OF THE INVENTION

1. Field of the Invention

This application is filed under 35 U.S.C. 371 and based on PCT/EP98/04331, filed Jul. 13, 1998.

This invention relates to the cleaning of fermentation or storage tanks in the beverage industry. More particularly, the invention relates to the cleaning of tanks in which beverages prepared by fermentation, such as in particular beer, are produced and/or stored.

2. Discussion of the Related Art

In the production and/or storage of beverages produced by fermentation processes such as, in particular, alcoholic fermentation, soils and residues that are particularly difficult to remove are commonly formed. As in the production of beer for example, these residues can contain tannins, hop resins and similar poorly soluble residues. At present, cleaning is carried out expensively and far from satisfactorily with conventional cleaning compositions. Cleaning may be carried out, for example, with alkaline cleaners based on about 1 to 3% caustic soda, optionally together with additives. Alternatively, acidic cleaners based for example on about 1 to 3% phosphoric acid may be used. The cleaning times are of the order of 20 to 60 minutes, the cleaning solutions having a temperature of about 5 to about 20° C.

Unfortunately, the cleaning results obtained for the obstinate residues of beverages prepared by fermentation in the storage and/or fermentation tanks are not always satisfactory. At the very least, expensive rinsing processes involving a high consumption of water are necessary. The disposal of the spent highly alkaline or strongly acidic cleaners leads to significant wastewater pollution.

Accordingly, processes for cleaning fermentation and/or storage tanks in the beverage industry are in need of improvement in regard to their cleaning results, water consumption and wastewater pollution.

DESCRIPTION OF THE INVENTION

The solution to this problem is based on the discovery that a particularly good cleaning effect with respect to tannins, hop resins and similarly obstinate soils can be achieved by using certain enzyme-containing formulations. Accordingly, the present invention relates to the use of enzyme-containing aqueous solutions for cleaning storage or fermentation tanks in the beverage industry. More particularly, the invention relates to the use of such solutions for cleaning fermentation or storage tanks in which beverages obtained by fermentation, for example by alcoholic fermentation, are produced or stored. One particular example of such a beverage is beer.

The aqueous cleaning solutions preferably contain one or more enzymes selected from the following groups: laccases, peroxidases, oxireductases, transferases, hidrolases, isomerases, lyases, proteases and ligases. It is particularly preferred to use laccases or peroxidases which are preferably used in combination with one another.

The aqueous cleaning solutions are preferably used in such a way that the total concentration of enzymes in the aqueous cleaning solution is in the range from about 0.001 to about 1% by weight. The use of lower concentrations has an adverse effect on the cleaning result whereas the use of concentrations higher than about 1% by weight does not significantly improve the cleaning result. The concentrations of the individual enzymes are preferably in the range from about 0.002 to about 0.3% by weight. If several enzymes are combined with one another, the total concentration is preferably adjusted to a value of about 0.005 to about 0.5% by weight.

The pH value of the enzyme-containing aqueous cleaning solution is preferably in the range in which the enzymes develop their optimal effect. Different pH ranges have proved to be optimal according to the type of enzyme. In general, the pH value should be in the range from about 2 to about 11. In the preferred use of laccases and/or peroxidases, the pH is preferably adjusted to a value of about 3 to about 10.

It is generally sufficient if the enzyme-containing aqueous solution contains no other active ingredients than the enzymes. Depending on the nature of the soils, however, the enzyme effect can be improved by the addition of other active ingredients. These include, for example, 1. nonionic, anionic or cationic surfactants, more particularly anionic surfactants, such as for example alkyl sulfates, or nonionic surfactants, such as for example alkoxylates of fatty alcohols or fatty amines;
2. monomeric, oligomeric or polymeric phosphates, more particularly diphosphates;
3. silicates;
4. organic complexing agents such as, for example, hydroxycarboxylic acids such as, in particular, lactic acid, citric acid, tartaric acid or gluconic acid, chelating aminocarboxylic acids such as, for example, ethylenediamine tetraacetic acid or nitrilotriacetic acid, phosphonic acids such as, for example, 1-hydroxyethane-1,1-diphosphonic acid or phosphonocarboxylic acids such as, for example, phosphonobutane tri-carboxylic acid.

In another embodiment, the present invention relates to a process for cleaning fermentation and/or storage tanks in the beverage industry, more particularly tanks for beverages obtained by fermentation, in which the tanks are treated for about 30 minutes to about 5 hours with an enzyme-containing aqueous solution containing the components described above. Treatment times of 10 to 60 minutes are preferred. In the most simple case, the treatment may be carried out by filling the tanks with the enzyme-containing aqueous solution or by spraying the inner walls of the tanks with the enzyme-containing aqueous solution. The cleaning effect can be intensified by the mechanical action of a powerful spray jet. The temperature of the enzyme-containing aqueous solution is preferably in the range from about −5 to +85° C. and more particularly in the range from about 20 to about 70° C.

The cleaning process according to the invention may also be carried out as a CIP (cleaning in place) process. In this case, the cleaning solution is stored in a stacking container and pumped from that container through a pipe system into the tank to be cleaned and then back into the stacking container. Since the same cleaning solution can thus be used for several cleaning cycles, the consumption of cleaning solution is reduced.

In addition, the cleaning solution according to the invention may also be formulated and used as a so-called thin film cleaner. In this case, the flow properties (viscosity, thixotropy) of the cleaning solution are adjusted by the addition of suitable thickeners so that the solution can be sprayed onto the walls of the tanks to be treated and adheres to or slowly runs down the walls in the form of a thin film. The surfaces to be cleaned thus remain in contact with the cleaning solution for a long time without the tank as a whole having to be filled. A comparatively small volume of cleaning solution is thus sufficient. At the end of the desired contact time, the thin film cleaner can be rinsed off with water. Thin film cleaners of the type in question are known in the prior art, but without the enzymes to be used in accordance with the invention. For example, EP-B-265 979 (Akzo) describes thickening premixes for the preparation of thickened aqueous single-phase cleaners which consist of 0.1 to 10% by weight of a surfactant, for example a tertiary amine oxide, and 0.01 to 3% by weight of an organic anionic sulfonate. These thickened aqueous cleaners show thixotropic behavior, in other words they develop a high viscosity on exposure to low shear forces. EP-A-276 501 (Akzo) also describes thickened aqueous cleaners with thixotropic behavior which contain a primary, secondary or tertiary amine or diamine containing at least one hydrocarbon radical of at least 10 carbon atoms and an organic sulfonate and a weak acid with a pK value of less than 2.0. Other documents concerned with thickening cleaning concentrates are, for example, WO 96/21721 (Jeyes Group plc), EP-A-0 724 013 (Colgate-Palmolive) and U.S. Pat. No. 5,078,896 (Akzo).

Thus, DE-OS 46 04 636 (Henkel KGaA) describes thickening aqueous cleaners for hard surfaces which contain a combination of at least one tertiary amine oxide, at least one alkyl polyglycoside and at least one water-soluble organic solvent selected from the group of monohydric or polyhydric alcohols, glycol ethers and alkanolamines. The document in question does not mention the use of the cleaners for the insides of pipes or tanks.

WO 95/02664 (Jeyes Group plc) also describes cleaners thickenable by addition of water which contain either ether sulfates, optionally in combination with other surfactants, or cationic surfactants, optionally together with nonionic surfactants. In this case, too, the cleaners in question are only intended for use on hard external surfaces, such as lavatory bowls, walls or floors.

U.S. Pat. No. 4,842,71 (Akzo N.V.) describes cleaning solutions which reduce their viscosity on shearing (thixotropic behavior) and which contain quaternary ammonium salts or amine oxides and cumene sulfonate, xylene sulfonate, toluene sulfonate or mixtures of the sulfonates. These solutions are intended for use on non-horizontal hard surfaces.

EP-A-0 595 590 (Page, White & Farrer) discloses a chlorine-free, low-alkali cleaning concentrate which contains amine oxides, anionic surfactants, a hydrophobicized polymer, a diluent and alkalis and which forms a gel film on hard surfaces.

EP-A-0 314 232 (Unilever) describes water-thickenable cleaning concentrates which contain a surfactant from the group of amines, amine oxides and quaternary ammonium salts, a co-surfactant, ionizable compounds and water. These cleaners are also intended for hard surfaces.

Accordingly, water-thickenable cleaning concentrates contain surface-active components, including both anionic surfactants, cationic surfactants and nonionic surfactants and possibly amphoteric surfactants, diluents, acidic or alkaline constituents, builders and co-builders, for example polymers, and other auxiliaries and additives. Aqueous solutions which may be used as thin layer cleaners in accordance with the present invention are obtained by adding the enzymes to be used in accordance with the invention to such mixtures. Depending on the application envisaged, the cleaning concentrate may contain other components, for example additional alkalis, chelating agents, other anionic and/or nonionic surfactants, enzymes, preservatives, sequestrants, oxidizing (bleaching) agents, dyes and/or perfumes.

Using the thickener systems described in the foregoing, the enzyme-containing aqueous solutions according to the present invention may also be formulated as thin layer cleaners.

After cleaning, the tanks are preferably rinsed out with tap water. The amount of water required for rinsing can be distinctly reduced by comparison with conventional strongly acidic or highly alkaline cleaning. This leads to a significantly reduced consumption of water. Since the pH value of the enzyme-containing cleaning solution is preferably in the approved range for wastewater, there is no longer any need for the otherwise necessary dilution or neutralization. Accordingly, the volume and pollution level of the wastewater can be significantly reduced.

EXAMPLES

The cleaning process according to the invention was tested by a so-called fermentation simulation test. To this end, 200 g of malt extract (Malt Extract Broth) were weighed into a 3-liter Erlenmeyer flask and made up to 2 kg with deionized water. The malt extract was heated to 90° C. with continuous stirring and completely dissolved. 1.7 g of size-reduced hop pellets were then added and, after boiling for 2 hours, the solution was cooled to around 10° C. in an ice bath and 20 g of yeast were added. This mixture was left to ferment for 5 days at room temperature. After the fermentation process, the Erlenmeyer flask was completely emptied and rinsed once with tap water so thoroughly that the yeast was completely removed.

The fermentation residue adhering to the inside of the flask, which contains inter alia smut yeast, tannins and hop resins, was then removed with enzyme-containing aqueous solutions according to the invention and, for comparison, with a conventional acidic tank cleaner. To this end, the Erlenmeyer flask was filled with the cleaning solutions. The cleaning solutions were at room temperature and were stirred at around 50 revolutions per minute. The dissolution of the fermentation residues was observed. A visual comparative evaluation of the percentage removal of soil by the enzyme-containing aqueous cleaning solutions according to the invention and by a tank cleaner used in practice was made after 30 minutes and 60 minutes. The following Table shows the percentage removal of soil in % after 60 minutes. Aqueous solutions containing the active ingredients listed in the Table (concentrations in % by weight) were used.

TABLE

Cleaner and cleaning results

| Active ingredient (concentration in water) | Removal of soil in % after 60 minutes |
|---|---|
| Laccase 0.005% | 70 |
| Peroxidase 0.005% | 70 |
| Laccase/peroxidase 0.003/0.005% | 90 |
| Protease 0.005% | 80 |
| Commercially available acidic tank cleaner 1% | 55 |

What is claimed is:

1. A process for cleaning fermentation or storage tanks comprising:

(a) forming a cleaning solution comprising a mixture of laccases and peroxidases; and (b) contacting said cleaning solution with a fermentation or storage tank;

wherein said fermentation or storage tank contains residue from a beverage obtained by fermentation.

2. The process of claim 1 wherein said cleaning solution comprises 0.001 to 1 percent by weight of enzymes.

3. The process of claim 1 wherein said cleaning solution comprises 0.002 to 0.3 percent by weight of enzymes.

4. The process of claim 2 wherein said cleaning solution comprises 0.005 to 0.5 percent by weight of two or more enzymes.

5. The process of claim 1 wherein said cleaning solution has a pH of from 2 to 11.

6.The process of claim 5 wherein said cleaning solution has a pH of from 3 to 10.

7. The process of claim 1 wherein said cleaning solution further comprises:

(a) surfactants, wherein said surfactants are selected from the group consisting of nonionic surfactants, anionic surfactants, and cationic surfactants;

(b) phosphates, wherein said phosphates are selected from the group consisting of monomeric phosphates, oligomeric phosphates, and polymeric phosphates;

(c) silicates; or (d) organic complexing agents.

8. The process of claim 1 wherein said fermentation or storage tank is contacted with said cleaning solution for from 30 minutes to 5 hours.

9. The process of claim 1 wherein said fermentation or storage tank is contacted with said cleaning for from 10 to 60 minutes.

10. The process of claim 1 wherein the temperature of said cleaning solution is from −5° C. to +85° C.

11. The process of claim 10 wherein the temperature of said cleaning solution is from 20° C. to +70° C.

12. The process of claim 1 wherein said cleaning solution contacts said fermentation or storage tank in a CIP (cleaning in place) process.

13. The process of claim 1 wherein said residue comprises yeasts, tannins, hops resins, or a mixture thereof.

* * * * *